United States Patent [19]

Shah

[11] 4,445,106

[45] Apr. 24, 1984

[54] SPIRAL WOUND FUSE BODIES

[75] Inventor: Nitin Shah, Taylor, Mich.

[73] Assignee: Littelfuse, Inc., Des Plaines, Ill.

[21] Appl. No.: 194,778

[22] Filed: Oct. 7, 1980

[51] Int. Cl.[3] ..... H01H 85/04

[52] U.S. Cl. ..... 337/163; 337/166; 337/295; 337/297

[58] Field of Search ..... 337/159, 161, 208, 163, 337/290, 166, 292, 295, 297; 29/623

[56] References Cited

U.S. PATENT DOCUMENTS

| | | | |
|---|---|---|---|
| 2,672,540 | 3/1954 | Dewey | 337/293 |
| 2,879,364 | 3/1959 | Mucher | 337/208 |
| 3,845,439 | 10/1974 | Deelman | 337/295 |
| 4,122,426 | 10/1978 | Marvo | 337/297 |
| 4,177,444 | 12/1979 | Taki | 337/290 |
| 4,189,696 | 2/1980 | Beswick et al. | 337/292 |
| 4,297,666 | 10/1981 | Asdollahi | 337/295 |

FOREIGN PATENT DOCUMENTS

| | | | |
|---|---|---|---|
| 2616718 | 10/1976 | Fed. Rep. of Germany | 337/290 |

*Primary Examiner*—William H. Beha, Jr.

*Attorney, Agent, or Firm*—Wallenstein, Wagner, Hattis, Strampel & Aubel

[57] ABSTRACT

A spiral wound fuse body comprises a core of insulating material formed by a limp, dead yarn made of twisted together initially sizing-coated strands of fine ceramic filaments, where the sizing was subsequently removed so that there is no sizing to leave a conductive residue under fuse blowing conditions. Such a fuse body is mass produced by spiral winding fuse wire upon a continuous length of said yarn unwinding from a spool upon which the yarn was wound when the sizing was removed. The resulting self-supporting body can be wound into rolls and subsequently unwound so that individual fuse bodies can be severed from the end of the unwinding roll of fuse body-forming material.

4 Claims, 7 Drawing Figures

Fig 1
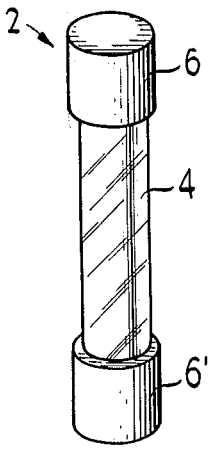
Fig 5
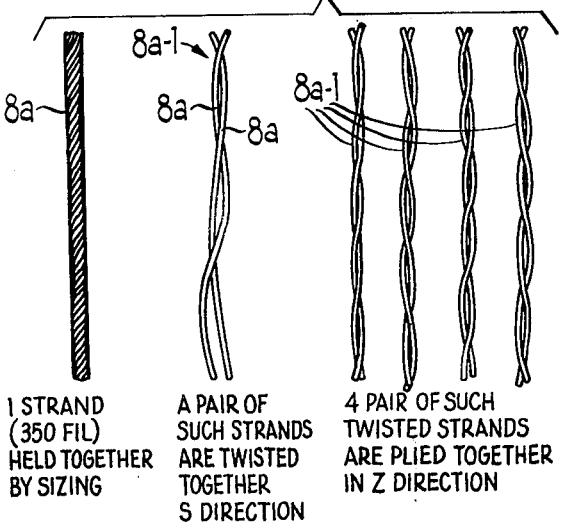
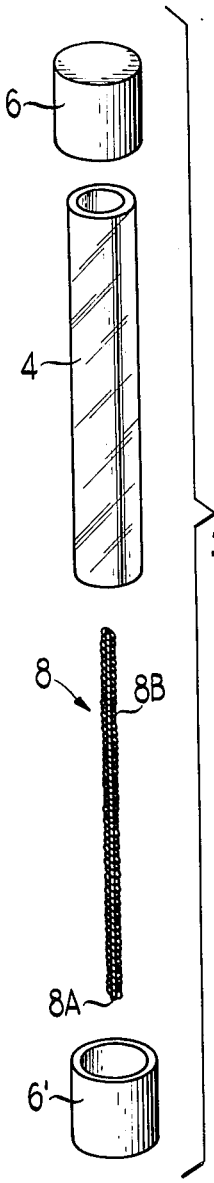
Fig 3
Fig 2
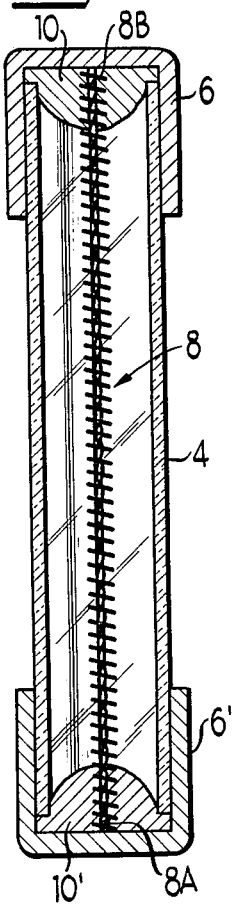
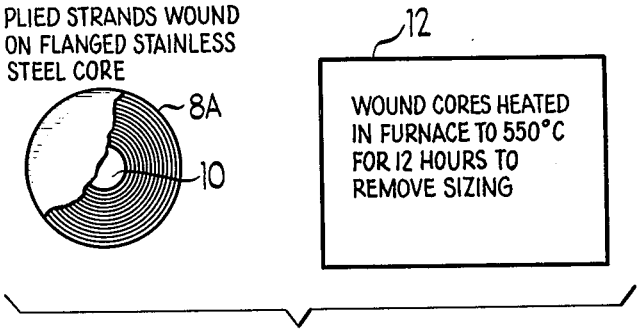
Fig 6
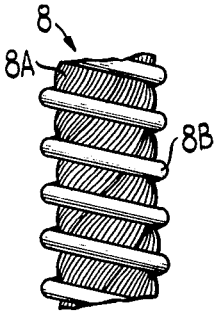
Fig 4
Fig 7
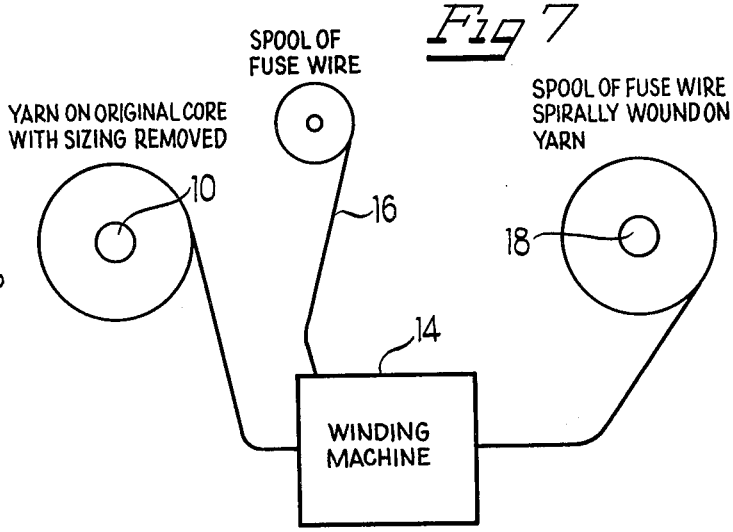

SPIRAL WOUND FUSE BODIES

BACKGROUND OF INVENTION

The present invention relates to slow blowing fuses of the type which commonly comprise a cylindrical insulating housing having metal terminal-forming end caps between which extend within the housing a fuse body including fuse wire spirally wound upon a support core which acts as a heat sinking body for extending the time it takes the fuse to blow when a current of a given value flows through the fuse wire. Slow blowing fuses are utilized in environments where the electrical circuit in which the fuse is located is not to be interrupted by blowing of the fuse unless an undesired level of current flows for a given minimum length of time.

The cores upon which the fuse wire has been heretofore wound have taken a number of different forms. For example, as disclosed in U.S. Pat. No. 2,672,540 granted Mar. 16, 1954 to G. J. Mucher, the core comprises a rigid body of ceramic material over which the fuse wire is wound. The main disadvantage of such a rigid ceramic core material is that a rigid body cannot be wound into rolls, and so must be individually supported and handled during the fuse assembly procedure, increasing the cost of manufacturing such fuses as compared, for example, to a fuse body construction where the core is made of a windable, flexible material which can be wound into rolls, as, for example, disclosed in U.S. Pat. No. 2,879,364, granted Mar. 24, 1979 to G. J. Mucher. Thus, where a flexible core material can be wound into rolls, fuse bodies can be readily mass produced by unwinding the core material and then spirally winding the fuse wire therearound, and either immediately severing individual fuse bodies from the end of the fuse wire, or rewinding the filament wire wound core of material into rolls and then subsequently unwinding the rolls and severing the fuse bodies therefrom during the process of assembling a complete slow blowing fuse (where each fuse body is enclosed in and soldered to end caps of a housing then sealed from the surrounding atmosphere).

In the manufacture of cores of a material comprising filament of a material like fiber glass, the cores are formed from twisted strands of the material involved. To maintain the integrity of such twisted strands of material, the individual strands are held together by a suitable binding material referred to as "sizing", which is generally a synthetic resin material. Unfortunately, the temperature conditions occurring during the blowing of a fuse having a fuse body made of fuse wire wound around such a sizing-containing core results in the carbonization of the binding material, which leaves a coating of conductive carbon along the core. Many fuse applications require a very large insulating resistance between the terminals of the fuse when the fuse is blown, and so it has been found that the carbonization described frequently reduces the insulating resistance between the terminals of the fuse below the high desired insulating resistance now commonly required for such fuses.

It is, accordingly, an object of the present invention to provide a unique spiral wound fuse body where the core material upon which the fuse wire is wound is one which can be readily wound and unwound from a spool and which does not result in carbonization under fuse blowing conditions, so that a high insulation resistance is present after a fuse made therefrom is blown.

SUMMARY OF THE INVENTION

The article of the present invention involves a new use of twisted strands of insulating material, preferably a ceramic material presently being manufactured by the 3M Company of St. Paul, Minn. and which was heretofore used for purposes completely different from that of a heat sinking core for a supporting fuse wire. The 3M twisted strands of ceramic material best suited for the invention is identified as Nextel 312 ceramic fiber, a ceramic fiber made of an alumina-boria-silica composition. 3M manufactures these strands into yarn which can be woven into a fabric for use as wire insulation, welding blankets, splash curtains and fabrics for personal protection. The yarn has good chemical resistance, very low thermal conductivity, thermal shock resistance, non-porosity, strength and exceedingly good electrical insulating properties. The yarn is made by forming individual strands each comprising a large number of twisted ceramic filaments held together by a resinous sizing which maintains the integrity of each strand. Pairs of such strands are twisted together in one direction and then a number of such twisted together pairs of strands are twisted together in the opposite direction to form what is referred to as a balanced or dead body of yarn which can be handled readily, wound into rolls and unwound therefrom without any serious kinking or snarling problems.

Since one of the important publicized applications of this ceramic yarn is its heat insulation characteristics requiring a very low thermal conductivity, it is believed that before the present invention such a material was not seriously considered to be useful as a heat-sinking core for fuse wire windings. Moreover, since the individual strands are held together by a resinous binding material which carbonizes under the temperature conditions present during the blowing of a fuse utilizing the same as a core for a fuse wire winding, it would not appear that this yarn material would be any more useful than the previously utilized fiber glass core material. However, it was found that a ceramic yarn like that manufactured by the 3M Company forms an exceedingly useful core material for making spiral wound fuse bodies when subjected to a special processing operation which removes the resinous binding material after the yarn is formed. Thus, while the binding material is needed in the process of making the yarn, once the yarn has been fabricated, the binding material can be removed from the yarn, as by placing it in a furnace and subjecting it to elevated temperatures for a prolonged length of time. Moreover, even though the strength and integrity of the yarn may be somewhat lessened by the removal of the binding material, any problems resulting therefrom are preferably minimized by subjecting the yarn material to the elevated temperatures which vaporizes the binding material while the yarn is maintained in a roll, so that the pressure of succeeding windings of the material will aid in maintaining the integrity thereof, and by keeping the yarn in roll form on its original processed core until it must be unwound for winding the fuse wire therearound where the fuse wire winding maintains the integrity of the yarn.

As a result of fabricating slow blow fuses with fuse bodies made in the manner just described, it was found that such fuses can be very inexpensively mass produced and provide insulation resistance under blown conditions which far exceed those made with fuse bodies including fiber glass cores as described.

DESCRIPTION OF DRAWINGS

FIG. 1 is a perspective view of a slow blowing fuse made in accordance with the present invention;

FIG. 2 is a greatly enlarged longitudinal sectional view through the fuse shown in FIG. 1;

FIG. 3 is an exploded view of the different parts forming the fuse shown in FIGS. 1 and 2;

FIG. 4 is a greatly enlarged view of a portion of the fuse body shown in FIG. 3;

FIGS. 5 and 6 illustrate the method of making and processing the core material upon which the fuse wire of the fuse body shown in the previous Figures is wound; and FIG. 7 illustrates the process of fabricating a roll of fuse body-forming material from which individual fuse bodies for slow blowing fuses are formed by severing short lengths thereof from the end of such a roll of fuse body-forming material.

DESCRIPTION OF EXEMPLARY FORMS OF THE INVENTION SHOWN IN THE DRAWINGS

The slow blowing fuse illustrated in the drawings in FIGS. 1–4 and generally indicated by reference numeral 2 includes a main clyindrical casing 4 of a suitable insulating material, like glass or a ceramic material, closed by conductive end caps 6–6'. A spiral wound fuse body 8 is in electrical contact with and extends between the end caps 6–6' where the fuse wire portion of the body 8 is intimately anchored and electrically connected to these end caps by solder 10–10'.

As previously indicated, the present invention involves a unique spiral wound fuse body 8 which comprises a core of a very limp, dead yarn 8A comprising twisted filaments or strands of an electrical insulating, heat-sinking material, preferably a ceramic material like that manufactured by the 3M Company and identified as the Nextel 312 ceramic fiber, processed in a unique way to be described, so that the core 8A is substantially devoid of any sizing or other binding material which will carbonize when subjected to the conditions of a blowing fuse. A fuse wire winding 8B is bound around the ceramic yarn core 8A. The fuse wire may be a tin-coated or uncoated body of fuse wire of copper or other material which gives the desired blowing qualities under the heat sinking conditions of the core 8A. For example, in one exemplary fuse designed to blow when 4 amps of current flows for 12–60 seconds, the fuse body had the following parameters:

- Fuse Wire—0.0067" diameter copper wire coated with an 0.0005" thick coating of tin; 46 windings per inch on the core.
- Core—0.043" diameter of 3M 312 Nextel ceramic fiber yarn comprising 4 strands of ceramic filaments twisted in the manner to be described. Each strand comprises 390 filaments.
- Housing—glass cylinder 0.019" thick with 0.183" inner diameter.

Differently rated fuses may be achieved by varying the diameter or composition of the basic fuse wire, the thickness of the coating of the low temperature melting coating, and the heat sinking characteristics of the core 8A.

While the flexible core 8A could be made of a variety of different material constructions and sizes, in the commercial form of the invention the yarn is made in the manner illustrated in the process diagram of FIG. 5. As there illustrated, the yarn core 8A is made of four pairs 8*a*-1 of twisted 110 sizing-coated strands 8*a* of 3M Nextel 312 ceramic fibers or filaments, there being 390 filaments in each strand 8*a*. The pairs 8*a*-1 of strands 8*a* are twisted together in a first 5 direction using approximately 2.7 twists per inch. Four pairs of such twisted strands are then twisted together in the opposite 2 direction using approximately 2.7 twists per inch, to form the completed yarn core 8A. The resulting yarn is then wound upon a preferably stainless steel flanged core 11 (See FIG. 6) and the resulting rolls of yarn are placed into a furnace heated to 550° centigrade for about 12 hours, to vaporize substantially all of the sizing. The thermal conductivity of the ceramic yarn 8A produced as described at a temperature of 200° centigrade is approximately 1–3 BTU/HR/SQ. FT./°F./FT. This thermal conductivity is substantially greater than the thermal conductivity, for example, of asbestos, but is less than the thermal conductivity of fiberglass previously used as a core material for spiral wound fuse bodies. However, as previously indicated, these prior fiberglass cores were unsatisfactory for a number of reasons including the fact that they apparently required and included sizing in the cores and so a carbon deposit is left on the cores when the fuse wire wound thereon blows.

Refer now to FIG. 7 which illustrates the manner in which a processed roll of yarn wound on the original stainless steel core 10 is wound with fuse wire. As there shown, the roll of yarn is unwound from the core 10 and passed to a conventional wire winding machine 14 to which also is fed the unwound end of a spool 16' of fuse wire 16. The machine 14 winds the fuse wire around the yarn with the desired winding spacing. Although the yarn is limp when the fuse wire 16 is wound there around, the resulting elongated body of fuse body-forming material is self-supporting, although it is windable into a roll. Accordingly, the yarn core 8A with the fuse wire 16 mounted thereon may be wound upon a suitable spool 18 for subsequent use in the assembly operation of slow blowing fuses, or can be immediately severed into completed fuse bodies of the desired length if the fuse wire winding operation is to be integrated into a fuse assembly operation. In either event, the fact that the fuse body material can be wound into a roll as illustrated in FIG. 7 greatly facilitates the handling and the formation of the individual fuse bodies 8 as they are fed to the situs of the assembly operation, where individual fuse bodies are severed from the end of the unwinding roll of the fuse body-forming material and then dropped into place one at a time within the open tops of the cylindrical casings 4 placed upon a solder pellet-containing end cap prior to the application of the other end cap and associated solder pellet.

The present invention thus facilitates the mass production of slow blowing fuse bodies having substantially higher insulating resistances than previous fuses made with fuse bodies having windable cores.

It should be understood that numerous modifications may be made in the most preferred forms of the invention as previously described without deviating from the broader aspects of the invention.

I claim:

1. A slow blowing fuse body comprising a limp spiral wound core of insulating material around which is spirally wound a conductive fuse wire, said core of insulating material being an initially limp and substantially dead yarn made of twisted together strands of insulating filaments substantially devoid of any sizing or other filament binding mateial which will form a conductive path under fuse blowing conditions.

2. A slow blowing fuse body comprising a core of insulating material around which is spirally wound a conductive fuse wire, said core of insulating material being a limp yarn made of strands of insulating filaments twisted together in a manner to produce a dead yarn, each of the strands prior to being twisted and wound with said wire being held together with a binding material which can leave a conductive path under fuse blowing conditions but which is subsequently removed so that the core material is devoid of any material which will form a conductive path under fuse blowing conditions.

3. The slow blowing fuse body of claims 1 or 2 wherein said insulating filaments are made of ceramic material.

4. The fuse body of claims 1 or 2 mounted within an insulating casing having conductive terminals at the opposite ends thereof, the ends of said fuse wire wound around said core of insulating material being electrically connected to said terminals.

* * * * *